US011933310B2

(12) United States Patent
Ogawa et al.

(10) Patent No.: US 11,933,310 B2
(45) Date of Patent: Mar. 19, 2024

(54) VACUUM PUMP AND VACUUM PUMP COMPONENT

(71) Applicant: Edwards Japan Limited, Chiba (JP)

(72) Inventors: Yohei Ogawa, Chiba (JP); Yoshiyuki Sakaguchi, Chiba (JP); Nahoko Yoshihara, Chiba (JP)

(73) Assignee: Edwards Japan Limited, Chiba (JP)

( * ) Notice: Subject to any disclaimer, the term of this patent is extended or adjusted under 35 U.S.C. 154(b) by 264 days.

(21) Appl. No.: 17/610,957

(22) PCT Filed: May 22, 2020

(86) PCT No.: PCT/JP2020/020399

§ 371 (c)(1),
(2) Date: Nov. 12, 2021

(87) PCT Pub. No.: WO2020/241520

PCT Pub. Date: Dec. 3, 2020

(65) Prior Publication Data

US 2022/0252074 A1 Aug. 11, 2022

(30) Foreign Application Priority Data

May 31, 2019 (JP) ..... 2019-102115

(51) Int. Cl.
*F04D 19/04* (2006.01)
*F04D 29/40* (2006.01)

(52) U.S. Cl.
CPC ..... *F04D 19/042* (2013.01); *F04D 29/403* (2013.01)

(58) Field of Classification Search
CPC ..... F04D 19/042; F04D 19/04; F04D 29/403; F04D 29/34; F04D 17/168
See application file for complete search history.

(56) References Cited

U.S. PATENT DOCUMENTS 3,877,546 A * 4/1975 Shrader ..... F16N 7/366 184/6.18
3,936,238 A * 2/1976 Wycliffe ..... F04C 29/063 418/181

(Continued)

FOREIGN PATENT DOCUMENTS

JP 2006194083 A 7/2006
JP 2018035684 A 3/2018

(Continued)

OTHER PUBLICATIONS

PCT International Search Report dated Aug. 11, 20 for corresponding PCT application Serial No. PCT/JP2020/020399, 2 pages.

(Continued)

*Primary Examiner* — Woody A Lee, Jr.
*Assistant Examiner* — Joshua R Beebe
(74) *Attorney, Agent, or Firm* — Theodore M. Magee; Westman, Champlin & Koehler, P.A.

(57) ABSTRACT

A main-body casing having an inlet port or an outlet port, a rotatable rotor shaft, and a rotor coupled to the rotor shaft are provided. A recess portion opened toward the inlet port is formed in the rotor and a fastening portion (a first shaft portion and a second shaft portion) of the rotor shaft is exposed to the recess portion. A cover portion, which is fastened to the fastening portion by a cover-portion fixing bolt and covers at least a part of the recess portion, is formed having a container shape and has a reinforcing portion located in a periphery of the fastening portion that prevents deflection by increasing rigidity. The cover portion also has a contact-pressure generating portion which is pressed by fastening to the fastening portion in a fastening direction and causes a contact pressure to be generated in the fastening direction.

4 Claims, 3 Drawing Sheets

(56) References Cited

U.S. PATENT DOCUMENTS

| | | | | |
|---|---|---|---|---|
| 6,589,009 | B1 * | 7/2003 | Shiokawa | F04D 29/701<br>415/200 |
| 2007/0031270 | A1 * | 2/2007 | Maejima | F04D 19/042<br>417/423.4 |
| 2018/0058478 | A1 * | 3/2018 | Kimura | F04D 29/662 |
| 2019/0055949 | A1 * | 2/2019 | Watanabe | F04D 19/042 |

FOREIGN PATENT DOCUMENTS

| | | | |
|---|---|---|---|
| WO | 2017138154 | A1 | 8/2017 |
| WO | 2018174013 | A1 | 9/2018 |

OTHER PUBLICATIONS

PCT International Written Opinion dated Aug. 11, 20 for corresponding PCT application Serial No. PCT/JP2020/020399, 4 pages.

* cited by examiner

VACUUM PUMP AND VACUUM PUMP COMPONENT

CROSS-REFERENCE OF RELATED APPLICATION

This application is a Section 371 National Stage Application of International Application No. PCT/JP2020/020399, filed May 22, 2020, which is incorporated by reference in its entirety and published as WO 2020/241520A1 on Dec. 3, 2020 and which claims priority of Japanese Application No. 2019-102115, filed May 31, 2019.

BACKGROUND

The present invention relates to a vacuum pump such as a turbo-molecular pump and the like and components thereof.

In general, a turbo-molecular pump is known as one type of vacuum pumps. In this turbo-molecular pump, a rotor blade is rotated by energizing a motor in a pump main body so as to flick out gas molecules in a gas (process gas) sucked into the pump main body and to exhaust the gas.

In addition, some turbo-molecular pumps are of a type in which a recess portion (29) is provided in a rotor (20) on which a rotor blade (22) is formed as illustrated in WO2017/138154 which will be described later, for example. In the turbo-molecular pump of this type, a bolt (83) enters the recess portion (29), the bolt (83) is screwed into a rotor shaft (21) so that the rotor (20) and the rotor shaft (21) are coupled.

Moreover, in a turbo-molecular pump of a type illustrated in WO2017/138154, the recess portion (29) of the rotor (20) is closed by a flexible cover (80). This flexible cover (80) divides a space in the recess portion (29) from a space on an inlet side, and prevents leakage of the particle out of the recess portion (29), even if a particle (Fe particle or the like) is generated in the recess portion (29).

The discussion above is merely provided for general background information and is not intended to be used as an aid in determining the scope of the claimed subject matter. The claimed subject matter is not limited to implementations that solve any or all disadvantages noted in the background.

SUMMARY

A shape of the flexible cover (80) of the turbo-molecular pump as described above is a thin disc-shaped. Moreover, fixing of the flexible cover (80) is carried out by using the bolt (83). Thus, in the flexible cover (80), a center part was pressed and deflected by tightening of the bolt (83), a recess with a portion in contact with a head part of the bolt (83) as a bottom occurred in some cases. Furthermore, by means of tightening of the bolt (83), the flexible cover (80) was brought into a finely wavy state microscopically in some cases. And due to these events, a gap could be generated between an outer-peripheral edge portion of the flexible cover (80) and the rotor (20).

An object of the present invention is to provide a vacuum pump in which a gap caused by tightening of the bolt is hardly generated and a vacuum pump component.

(1) In order to achieve the aforementioned object, the present invention is a vacuum pump including:
a casing having an inlet port or an outlet port;
a rotatable rotor shaft; and
a rotor coupled to the rotor shaft, in which
a recess portion opened toward the inlet port is formed in the rotor;
a fastening portion of the rotor shaft is exposed to the recess portion; and
a cover portion which is fastened to the fastening portion by a fastening means and covers at least a part of the recess portion is provided,
the cover portion being formed having a container shape and having:
a reinforcing portion located in a periphery of the fastening portion and preventing deflection by increasing rigidity; and
a contact-pressure generating portion which is pressed by fastening to the fastening portion in a fastening direction and can cause a contact pressure to be generated in the fastening direction.

(2) The vacuum pump described in (1) is characterized in that a gap allowing deflection is formed between the reinforcing portion and the fastening portion.

(3) The vacuum pump described in (1) or (2) is characterized in that a contacted component with which the contact-pressure generating portion is in contact is provided in the recess portion; and
the cover portion causes the contact pressure to be generated on a contact surface with the contacted component.

(4) A vacuum pump component which can be fastened to a fastening portion of a rotor shaft provided in a vacuum pump and can cover at least a part of a recess portion of a rotor coupled to the rotor shaft, in which the vacuum pump component is formed having a container shape and has:
a reinforcing portion located in a periphery of the fastening portion and preventing deflection by increasing rigidity; and
a contact-pressure generating portion which is pressed by fastening to the fastening portion in a fastening direction and can cause a contact pressure to be generated in the fastening direction.

According to the aforementioned invention, a vacuum pump in which a gap caused by fastening of a bolt is hardly generated and a vacuum pump component can be provided.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
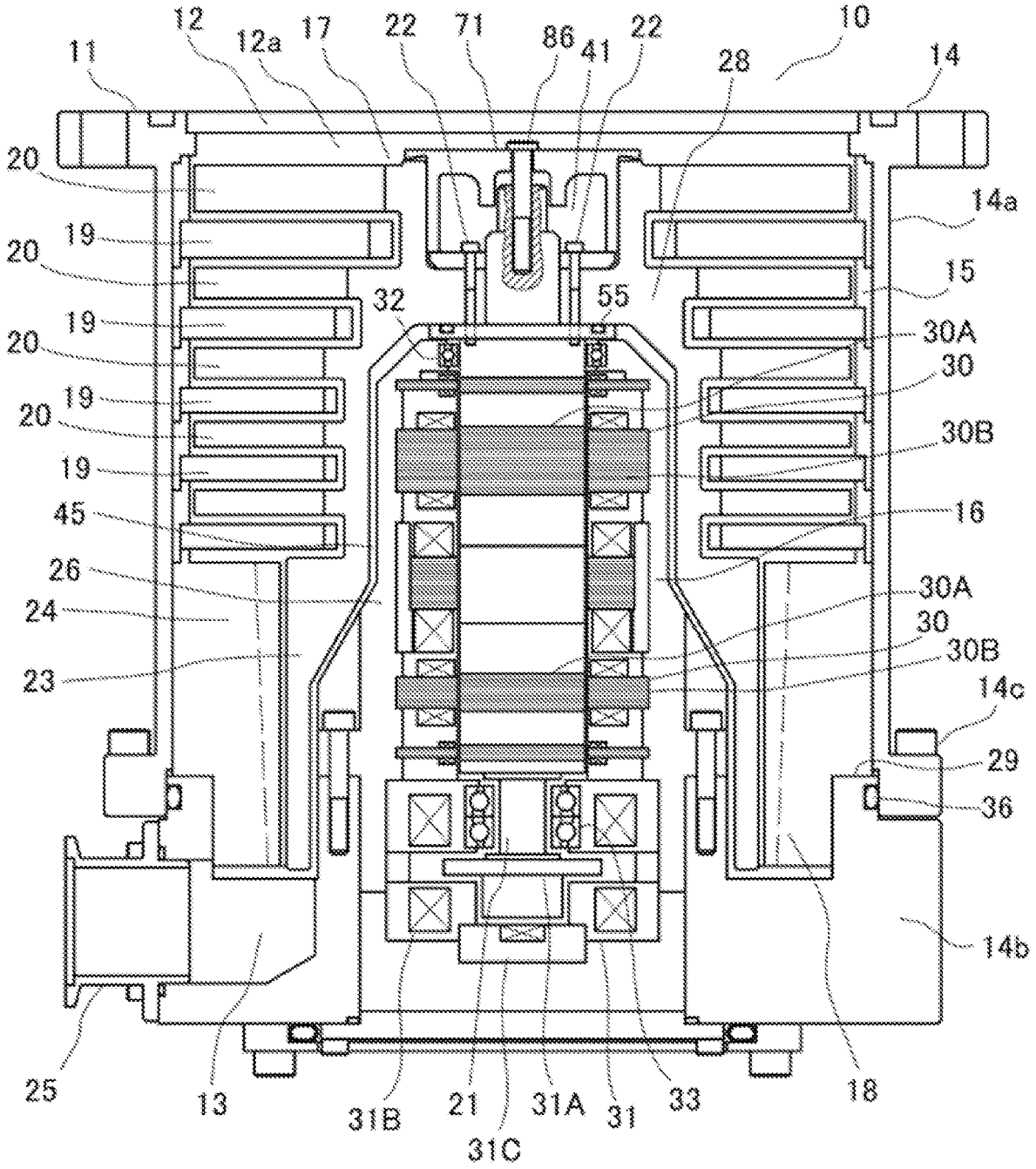
FIG. 1 is a vertical sectional view of a turbo-molecular pump according to a best preferred embodiment of the present invention.

A vacuum pump according to a best preferred embodiment of the present invention will be described below on the basis of drawings. FIG. 1 schematically illustrates a turbo-molecular pump 10 as a vacuum pump according to this embodiment in a vertical section. This turbo-molecular pump 10 is connected to a vacuum chamber (not shown) of a target device (device to be exhausted) such as a semiconductor manufacturing apparatus, an electronic microscope, a mass analysis device and the like, for example.

The turbo-molecular pump 10 integrally includes a cylindrical pump main body 11 and a box-shaped electric component case (not shown). In the pump main body 11 in them, an upper side in FIG. 1 is an inlet portion 12 connected with an inlet port directed to a side of a target device, and a lower side is an exhaust portion 13 connected to an auxiliary pump or the like. And the turbo-molecular pump 10 can be used not only in a perpendicular posture in a vertical direction as shown in FIG. 1 but also in an inverted posture, a horizontal posture, and an inclined posture.

The electric component case (not shown) accommodates a power-supply circuit portion for performing power supply to the pump main body 11 and a control circuit portion for controlling the pump main body 11, but detailed description of them is omitted here.

The pump main body 11 includes a main-body casing 14 as a casing to be a substantially cylindrical housing. The main-body casing 14 is constituted by an inlet-side casing 14*a* located on an upper part in FIG. 1 and an exhaust-side casing 14*b* located on a lower side in FIG. 1 connected in series in an axial direction. Here, the inlet-side casing 14*a* can be called a casing, for example, and the exhaust-side casing 14*b* as a base, for example.

The inlet-side casing 14*a* constitutes a part on an inlet side of the main-body casing 14, and the exhaust-side casing 14*b* constitutes a part on an exhaust side the of main-body casing 14. The inlet-side casing 14*a* and the exhaust-side casing 14*b* overlap in a radial direction (left-right direction in FIG. 1). Moreover, the inlet-side casing 14*a* has an inner peripheral surface on a one end portion (lower end portion in FIG. 1) in the axial direction opposed to an outer peripheral surface on an upper end portion 29 of the exhaust-side casing 14*b*. And the inlet-side casing 14*a* and the exhaust-side casing 14*b* are connected to each other in an air-right manner by a plurality of casing bolts 14*c* (bolt with hexagonal hole) with an O-ring (seal member 36) accommodated in a groove portion between them. Here, in FIG. 1, only a part of the plurality of casing bolts 14*c* is shown.

In the main-body casing 14 constituted as above, an exhaust mechanism portion 15 and a rotation driving portion (hereinafter, referred to as a "motor") 16 are provided. Among them, the exhaust mechanism portion 15 is of a composite type constituted by a turbo-molecular pump mechanism portion 17 as a pump mechanism portion and a thread-groove pump mechanism portion 18 as a thread-groove exhaust mechanism portion.

The turbo-molecular pump mechanism portion 17 and the thread-groove pump mechanism portion 18 are disposed so as to continue in the axial direction of the pump main body 11, and in FIG. 1, the turbo-molecular pump mechanism portion 17 is disposed on an upper side in FIG. 1, while the thread-groove pump mechanism portion 18 is disposed on a lower side in FIG. 1. Hereinafter, basic structures of the turbo-molecular pump mechanism portion 17 and the thread-groove pump mechanism portion 18 will be schematically described.

The turbo-molecular pump mechanism portion 17 disposed on the upper side in FIG. 1 is for transferring a gas by a large number of turbine blades and includes stator blades (hereinafter, referred to as "stator blades") 19 and rotor blades (hereinafter, referred to as "rotor blades") 20 having predetermined inclination and curved surfaces and formed radially. In the turbo-molecular pump mechanism portion 17, the stator blades 19 and the rotor blades 20 are disposed so as to be aligned alternately in approximately ten stages.

The stator blades 19 are provided integrally with the main-body casing 14, and the rotor blades 20 enter between the upper and lower stator blades 19. The rotor blades 20 are integrated with a cylindrical rotor 28, and the rotor 28 is concentrically fixed to a rotor shaft (also referred to as a "rotor shaft") 21 so as to cover an outer side of the rotor shaft 21.

Fixing of the rotor 28 to the rotor shaft 21 is performed by using a plurality of rotor fixing bolts 22 (only two of them are shown) on one end portion side in the axial direction of the rotor shaft 21 (upper end portion side in FIG. 1). A fixing structure with the rotor 28 on the end portion side (the upper end portion side in FIG. 1) of the rotor shaft 21 and a peripheral structure thereof will be described later.

The rotor shaft 21 is supported by a hollow-state stator column 26 through a magnetic bearing (which will be described later). The stator column 26 is coaxially bolted to the above-described exhaust-side casing 14*b* and supports the motor 16, the rotor shaft 21 and the like.

The rotor shaft 21 is worked into a stepped columnar shape and reaches the thread-groove pump mechanism portion 18 on the lower side from the turbo-molecular pump mechanism portion 17. Moreover, the motor 16 is disposed at a center part in the axial direction of the rotor shaft 21. This motor 16 will be described later.

The thread-groove pump mechanism portion 18 includes a rotor cylinder portion 23 and a thread stator 24. This thread stator 24 is also called an "exterior thread", and aluminum is employed as a material of the thread stator 24. An outlet port 25 to be connected to an exhaust pipe is disposed on a rear stage of the thread-groove pump mechanism portion 18, and an inside of the outlet port 25 and the thread-groove pump mechanism portion 18 are spatially connected.

The above-described motor 16 has a rotor (reference numeral omitted) fixed to an outer periphery of the rotor shaft 21 and a stator (reference numeral omitted) disposed so as to surround the rotor. Power supply for operating the motor 16 is performed by a power-supply circuit portion and a control circuit portion accommodated in the above-described electric component case (not shown).

Here, in the pump main body 11 of the turbo-molecular pump 10, an aluminum alloy and stainless steel are employed as materials of major components. For example, the material of the exhaust-side casing 14*b*, the stator blade 19, the rotor 28 and the like is an aluminum alloy. Moreover, the material of the rotor shaft 21, the rotor fixing bolt 22 and the like is stainless steel. Furthermore, in FIG. 1, description of hatching indicating a section of a component in the pump main body 11 is omitted except a part (a part of the rotor shaft 21) in order to avoid complexity of the figures.

In order to support the rotor shaft 21, a magnetic bearing which is a non-contact type bearing by magnetic suspension is used. As the magnetic bearing, two sets of radial magnetic bearings (radial magnetic bearings) 30 disposed above and below the motor 16 and one set of axial magnetic bearings (axial magnetic bearings) 31 disposed on a lower part of the rotor shaft 21 are used.

Each of the radial magnetic bearings 30 among them is constituted by a radial electromagnetic target 30A formed on the rotor shaft 21, a plurality of (two, for example) radial electromagnets 30B opposed thereto, a radial displacement sensor 30C and the like. The radial displacement sensor 30C detects radial displacement of the rotor shaft 21. And an exciting current of the radial electromagnet 30B is controlled on the basis of an output of the radial displacement sensor 30C, and the rotor shaft 21 is floated/supported so as to be rotatable around an axis at a predetermined position in the radial direction.

The axial magnetic bearing 31 is constituted by an armature disc 31A having a disc shape mounted on a part on a lower end side of the rotor shaft 21, axial electromagnets 31B opposed vertically with the armature disc 31A between them, an axial displacement sensor 31C installed at a position slightly away from a lower end surface of the rotor shaft 21 and the like. The axial displacement sensor 31C detects axial displacement of the rotor shaft 21. And on the basis of an output of the axial displacement sensor 31C, the exciting currents of the upper and lower axial electromagnets 31B are controlled, and the rotor shaft 21 is floated/supported so as to be rotated around the axis at a predetermined position in the axial direction.

And by using the radial magnetic bearing 30 and the axial magnetic bearing 31, such an environment is realized that there is no abrasion when the rotor shaft 21 (and the rotor blade 20) performs a high-speed rotation, a life is long, and a lubricant oil is not needed. Moreover, in this embodiment, by using the radial displacement sensor 30C and the axial displacement sensor 31C, rotation only in a direction (Oz) around an axial direction (Z-direction) is free, while positional control is executed for directions of X, Y, Z, Ox, and Oy, which are the other five axial directions for the rotor shaft 21.

Moreover, in the peripheries of an upper part and a lower part of the rotor shaft 21, protective bearings (also referred to as a "protective bearing", "touchdown (T/D) bearing", "backup bearing" and the like) 32, 33 are disposed in the radial direction at a predetermined interval. By means of these protective bearings 32, 33, even in the case of a trouble in an electric system or a trouble such as atmospheric entry or the like, for example, the position or attitude of the rotor shaft 21 is not changed largely, and the rotor blade 20 and a peripheral portion thereof are not damaged.

During an operation of the turbo-molecular pump 10 having such structure, the above-described motor 16 is driven, and the rotor blade 20 is rotated. And with the rotation of the rotor blade 20, a gas is sucked from the inlet portion 12 illustrated on the upper side in FIG. 1, and the gas is transferred to the thread-groove pump mechanism portion 18 side while causing gas molecules to collide against the stator blade 19 and the rotor blade 20. Moreover, the gas is compressed in the thread-groove pump mechanism portion 18, and the compressed gas enters the outlet port 25 through the exhaust portion 13 and is exhausted from the pump main body 11 through the outlet port 25.

It is to be noted that the rotor shaft 21, the rotor blade 20 integrally rotated with the rotor shaft 21, the rotor cylinder portion 23, the rotor (reference numeral omitted) of the motor 16 and the like can be collectively called a "rotor portion" or a "rotating portion" and the like, for example.

Figure 2A:
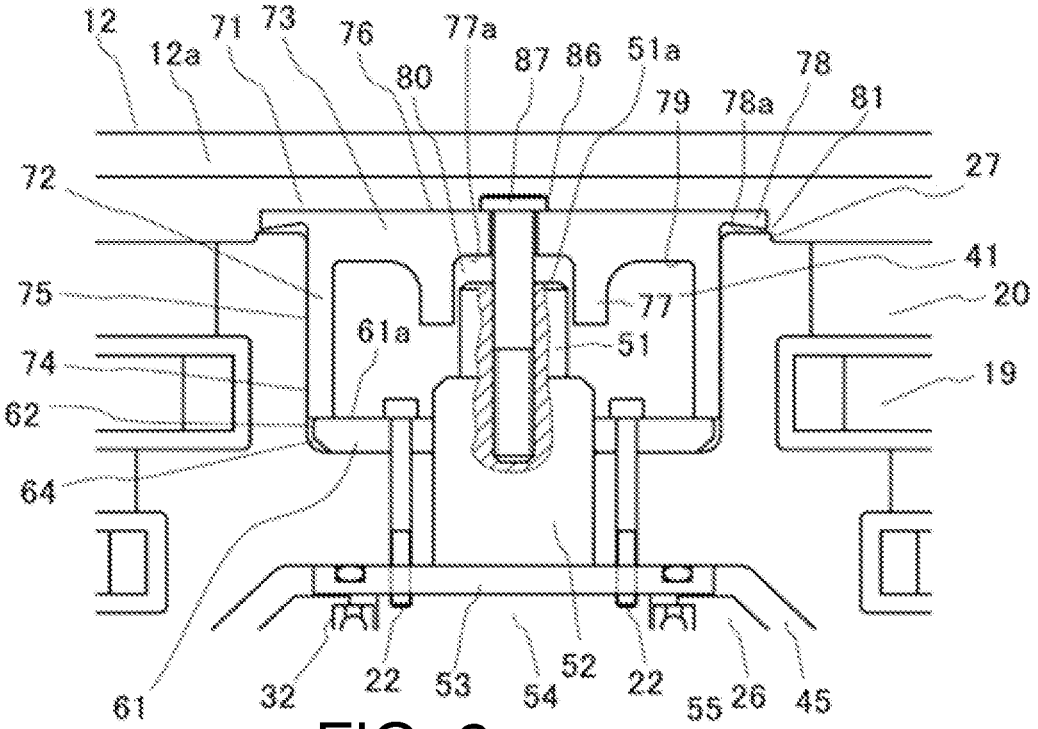
FIG. 2A is an enlarged view illustrating a cover portion and a peripheral portion thereof.

Subsequently, a coupling structure between the rotor shaft 21 and the rotor 28 on the one end portion side (the upper end portion side in FIG. 1) of the above-described rotor shaft 21 and a peripheral structure of a coupling portion will be described. FIG. 2A illustrates an upper end portion of the rotor shaft 21 in FIG. 1 and a peripheral portion thereof in an enlarged manner. As illustrated in FIG. 2A, the rotor shaft 21 is coupled to the rotor 28 through the plurality of rotor fixing bolts 22 (only two of them are illustrated).

In the rotor 28, a recess portion 41 opened in an exact circle state toward the inlet portion 12 side is formed. This recess portion 41 extends in the axial direction of the rotor 28 with a substantially equal inner diameter, and a bottom portion is worked to be substantially flat. One end portion of the rotor shaft 21 protrudes from the bottom portion of the recess portion 41.

As described above, the rotor shaft 21 is worked to a stepped columnar shape. As illustrated in FIG. 2A, the one end portion of the rotor shaft 21 is a first shaft portion 51 (fastening portion), and on a lower side in the figure, a second shaft portion 52 (similarly constituting the fastening portion) thicker than the first shaft portion 51 is formed coaxially with the first shaft portion 51.

Moreover, as illustrated in FIG. 2A, a flange portion 53 extending in the radial direction and a third shaft portion 54 thinner than the flange portion 53 and thicker than the second shaft portion 52 are formed on a part on the lower side of the second shaft portion 52. It is to be noted that, the other shaft portions and flange portions and the like are formed on the rotor shaft 21, but the first shaft portion 51, the second shaft portion 52, and the flange portion 53 are described here, while explanation on the other shaft portions and flange portions will be omitted.

The above-described rotor fixing bolt 22 is a bolt with a hexagonal hole made of stainless and is screwed into the flange portion 53 and the third shaft portion 54 of the rotor shaft 21 through a washer 61 (which will be described later) and the rotor 28 as contacted components. Moreover, an O-ring (seal member) 55 is fitted in a groove portion of the flange portion 53, and a space between the flange portion 53 and the rotor 28 is sealed air-tightly by the O-ring 55.

The above-described washer 61 is formed having a substantially exact annular shape and is disposed on the bottom portion of the recess portion 41. This washer 61 is in contact with the bottom surface of the recess portion 41, and a hole portion at a center of the washer 61 is penetrated by the second shaft portion 52 of the rotor shaft 21. Here, as a material of the washer 61, stainless steel or an aluminum alloy can be employed.

A corner portion on the lower side (lower side in FIG. 2A) of the washer 61 is chamfered so as to be a relief portion 62 that prevents interference with a curved surface portion (R portion) on the bottom portion of the recess portion 41. On the other hand, on the upper side (upper side in FIG. 2A) of the washer 61, chamfering to a minimum degree is applied to the corner portion, and an annular flat surface larger than the surface on the lower side is ensured.

Subsequently, to the recess portion 41 of the rotor 28, a cover portion 71 as a vacuum pump component covering an opening portion of the recess portion 41 is attached. This cover portion 71 is formed having a cylindrical shape with one end in the axial direction closed. A shape of the cover portion 71 can be called a container shape (cup shape), a cap shape and the like, for example. As a material of this cover portion 71, an aluminum alloy is employed.

The cover portion 71 has a cylindrical insertion portion (also referred to as a "skirt portion") 72 as a contact-pressure generating portion and a disc portion 73 having an exact circular shape. The insertion portion 72 and the disc portion 73 are integrally molded by cutting work, and the disc portion 73 has one end portion (base end portion) in the axial direction of the insertion portion 72 closed. And the cover portion 71 is fixed to the rotor 28 through a cover-portion fixing bolt 86 as a fastening means coaxially screwed into the rotor shaft 21. Details of a fixing structure of the cover portion 71 using this cover-portion fixing bolt 86 will be described later.

The above-described insertion portion 72 is formed having the substantially same outer diameter and inner diameter from the one end portion (the end portion on the upper side in FIG. 2A) connected to the disc portion 73 and closed to the other end portion (a distal end portion 74) which is open. Moreover, the insertion portion 72 enters the recess portion 41 formed in the rotor 28, and the distal end portion 74 of the insertion portion 72 reaches a plate surface 61*a* (plate surface directed to the inlet portion 12 side) of the washer 61. Furthermore, the insertion portion 72 is inserted by means of predetermined fitting in the recess portion 41.

An end surface in the distal end portion 74 of the insertion portion 72 is worked to be flat and is a flat surface orthogonal to the axial direction. And the distal end portion 74 of the insertion portion 72 is in planar contact annularly without discontinuation over an entire circumference (360°) on an outer-peripheral edge portion in the plate surface 61*a* of the washer 61.

Here, as illustrated in FIG. 2A, an outer diameter of the washer 61 is somewhat smaller than the outer diameter of the insertion portion 72. While an outer peripheral surface 75 of the insertion portion 72 is in a state of substantial contact with an inner peripheral surface of the recess portion 41, an outer peripheral surface 61*b* of the washer 61 slightly enters an inside from an outer periphery of the insertion portion 72, and a gap portion 64 is interposed between itself and the inner peripheral surface of the recess portion 41.

The above-described disc portion 73 of the cover portion 71 has an outer side surface 76 worked to be substantially flat exposed to an outer side of the recess portion 41. Moreover, on the disc portion 73, a cylindrical receiving portion 77 as a reinforcing portion located inside the insertion portion 72 and a thin nozzle forming portion 78 extending to the outer side of the insertion portion 72 are integrally provided.

Among them, the receiving portion 77 is formed concentrically with the insertion portion 72. A thickness of the receiving portion 77 (a difference between the outer diameter and the inner diameter) is somewhat larger than a thickness of the insertion portion 72. Moreover, a protruding amount of the receiving portion 77 is smaller as compared with a protruding amount of the insertion portion 72. Here, the protruding amounts of the receiving portion 77 and the insertion portion 72 are compared by using an intermediate flat surface 79 between the receiving portion 77 and the insertion portion 72 as a reference. And in this embodiment, the above-described protruding amount of the receiving portion 77 is ½ or less of the protruding amount of the insertion portion 72.

The receiving portion 77 receives an end portion of the first shaft portion 51 in the rotor shaft 21, and the end portion of the first shaft portion 51 enters a space inside the receiving portion 77. An inner diameter of the receiving portion 77 is somewhat (approximately several mm on one side in the radial direction, for example) larger than an outer diameter of the first shaft portion 51. Moreover, the first shaft portion 51 remains at a position substantially in the middle of a depth (depth in an upper direction in FIG. 2A) of the receiving portion 77. And between an end surface 51*a* of the first shaft portion 51 and a surface (ceiling surface) of a depth portion 77*a* of the receiving portion 77, a gap portion 80 as a gap of a predetermined size (approximately several mm to 10 mm, for example) is present.

The above-described nozzle forming portion 78 is formed annularly by a portion located on the outer side of the insertion portion 72 in the disc portion 73. The nozzle forming portion 78 extends in the radial direction in a vicinity of the opening portion of the recess portion 41. And as illustrated in FIG. 3, a thickness T1 of an outermost peripheral portion of the nozzle forming portion 78 is smaller than a thickness T2 of a portion on an inner side of the nozzle forming portion 78 (portion closer to a center of the disc portion 73 than the insertion portion 72) in the disc portion 73.

Moreover, the thickness T1 of the outermost peripheral portion of the nozzle forming portion 78 is smaller than a thickness T3 of a surface (ceiling surface) 77*a* of a depth portion in the receiving portion 77 in the disc portion 73. Furthermore, the thickness T3 of the surface (ceiling surface) 77 of the depth portion in this receiving portion 77 is somewhat smaller than a thickness (the thickness T2) of the portion on the outer side of the receiving portion 77. As described above, the disc portion 73 is constituted by a plurality of portions with different thicknesses. And the insertion portion 72 and the receiving portion 77 are located on a boundary portion between the portions with different thicknesses.

Figure 3:
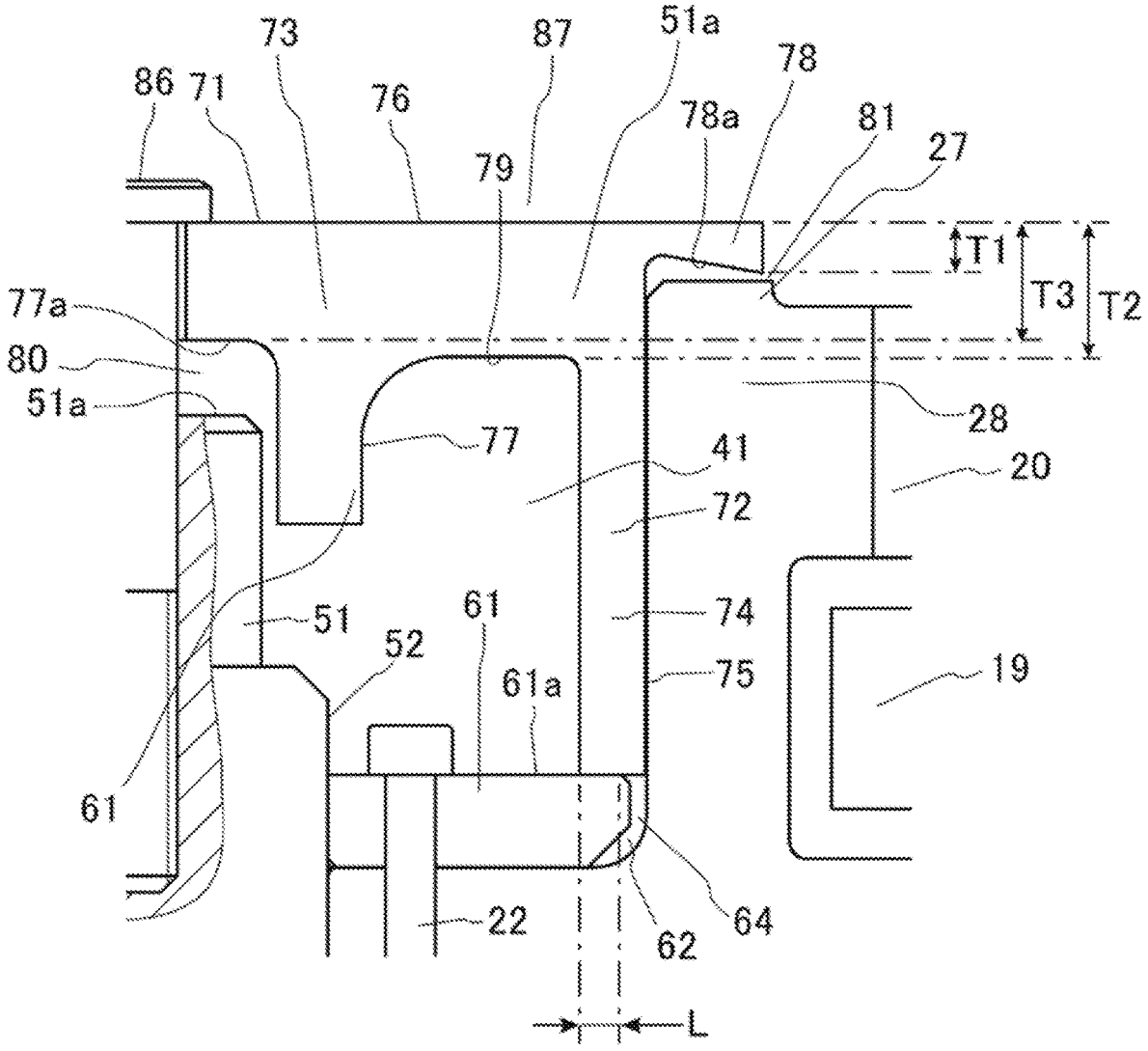
FIG. 3 is an enlarged view illustrating a nozzle portion and an inserting portion.

Moreover, a surface (a surface directed toward the rotor 28 side) 78*a* on the inner side of the nozzle forming portion 78 is worked diagonally so that it becomes gradually thinner from the outermost peripheral portion (the thickness T1) to a center side as illustrated in FIG. 3. In other words, the nozzle forming portion 78 is formed such that the thickness is gradually increased from the center side to the outer peripheral side. Furthermore, the surface 78*a* on the inner side of the nozzle forming portion 78 is inclined so as to get closer to the rotor 28 located on the exhaust side.

In a periphery of the opening portion of the recess portion 41, an opposing portion 27 opposed to the nozzle forming portion 78 is formed annularly. This opposing portion 27 is raised somewhat in a stepped state. And the opposing portion 27 has a flat surface extending in the radial direction at a right angle to the axial direction directed toward the nozzle forming portion 78. And between the opposing portion 27 and the nozzle forming portion 78, a nozzle portion 81 with a spatial sectional area getting narrower as it goes from the center side toward the outer side in the radial direction and with an opening getting thinner as it goes toward the outer peripheral side is formed annularly over the entire periphery (360°).

As the above-described cover-portion fixing bolt 86, a bolt of a low head (extremely low head) type made of stainless is used. The cover-portion fixing bolt 86 is inserted into a bolt hole penetrating a center part of the disc portion 73 in the cover portion 71 from an outer side and screwed into the rotor shaft 21. The cover-portion fixing bolt 86 is screwed into the first shaft portion 51 and reaches the second shaft portion 52. Here, as the cover-portion fixing bolt 86, a bolt (may be a set screw) with a small opening area (and an entire depth) of a tool insertion hole is used. Thus, as compared with the case of using the bolt with a hexagonal hole, a particle (particle) does not collect easily in the tool insertion hole.

By gradually screwing the cover-portion fixing bolt 86, a head part 87 of the cover-portion fixing bolt 86 pushes the disc portion 73 of the cover portion 71 toward a direction (fastening direction) where the rotor shaft 21 and the rotor 28 are present. And the insertion portion 72 of the cover portion 71 presses the distal end portion 74 onto the plate surface of the washer 61. As a result, a contact pressure (surface pressure) is generated on a contact surface (seal surface) between the insertion portion 72 and the washer 61. At this time, a space which is to be the gap portion 80 is ensured between the closed depth portion of the receiving portion 77 and an end surface of the first shaft portion 51 of the rotor shaft 21. And as illustrated in FIG. 3, a contact length L between the distal end portion 74 of the insertion portion 72 and the washer 61 is smaller than the thickness of the insertion portion 72.

Moreover, as described above, an aluminum alloy or stainless steel is used as a material of each component in the turbo-molecular pump 10 in this embodiment, and electroless nickel plating (electroless NiP plating or the like) is applied as surface treatment to major components in the components (here, the rotor shaft 21, the cover portion 71 and the like, for example) so as to improve corrosion resistance. Thus, even if a corrosive gas is used as a process gas, for example, a particle is not generated easily.

According to the turbo-molecular pump 10 as described above, the cover portion 71 has the insertion portion 72 and the disc portion 73, and is formed in a cap-like form. And rigidity of the cover portion 71 is such that the rigidity of the disc portion 73 is combined with the rigidity of the insertion portion 72. Thus, in the cover portion 71, not only the thickness of the disc portion 73 but also the entire rigidity can be ensured by the insertion portion 72.

Then, as compared with the case of using the thin-plate shaped flexible cover (80) as disclosed in WO2017/138154 disclosed above, entirely high rigidity can be easily given to the cover portion 71. Moreover, the rigidity of the disc portion 73 can be increased by the insertion portion 72, and the disc portion 73 can be made difficult to be deflection.

Here, circumstances where deflection (elastic deformation) occurs in the disc portion 73 include a case in which the cover-portion fixing bolt 86 is screwed into the rotor shaft 21 so as to assemble the cover portion 71 to the rotor 28, a case in which a centrifugal force acts on the cover portion 71 by high-speed rotation during an operation of the rotor 28 and the like.

And when the cover portion 71 is to be assembled, the head part 87 of the cover-portion fixing bolt 86 pushes the disc portion 73, whereby a force to recess the center part of the outer side surface 76 is generated. Moreover, during the operation, a force to expand the disc portion 73 to the outer side, a force to recess the center part of the outer side surface 76 of the disc portion 73, a force to expand the insertion portion 72 largely in a centrifugal direction as it goes toward the distal end portion 74 side and the like are generated by the centrifugal force accompanying the high-speed rotation.

However, in this embodiment, since the entire rigidity of the cover portion 71 is easily ensured as described above, occurrence of deflection can be easily prevented for any one of the above-described forces. Moreover, since the insertion portion 72 enters the recess portion 41 and brings the outer peripheral surface 75 into substantial contact with the inner peripheral surface of the recess portion 41 by predetermined fitting, occurrence of such deflection that the insertion portion 72 is expanded in the centrifugal direction as it goes toward the side of the distal end portion 74 or such deflection that the disc portion 73 is expanded to the outer side can be prevented.

Moreover, since the cover portion 71 is not constituted only by the disc portion 73 and the insertion portion 72 but has the receiving portion 77 protruding from the disc portion 73, the rigidity of the cover portion 71 can be improved also by the receiving portion 77. That is, by combining the insertion portion 72 and the receiving portion 77, the rigidity of the disc portion 73 is reinforced, and the entire rigidity of the cover portion 71 can be improved.

Here, the rigidity of the cover portion 71 can be also improved only by increasing the thickness of the disc portion 73. However, by providing the insertion portion 72 and the receiving portion 77 as in this embodiment, the rigidity of the cover portion 71 can be improved without relying only on the thickness of the disc portion 73.

Moreover, in this embodiment, since the rigidity is improved not only by the insertion portion 72 but also by the receiving portion 77, further thinning of the disc portion 73 can be enabled. And even in the case where the main-body casing 14 is small-sized, and a distance from the outer side surface 76 of the disc portion 73 to the inlet portion 12 cannot be ensured large, for example, sufficient rigidity can be ensured for the cover portion 71.

Moreover, since the bolt of a low head type is employed for the cover-portion fixing bolt 86, even in the case where the distance from the outer side surface 76 of the disc portion 73 to the inlet portion 12 cannot be ensured large, interference of the cover-portion fixing bolt 86 with the inlet portion 12 can be prevented.

Furthermore, since not only the insertion portion 72 but also the receiving portion 77 are formed on the disc portion 73, a stress generated in the cover portion 71 during assembling or an operation can be distributed more finely by a base end portion (corner portion in a connection portion with the disc portion 73) of each of the insertion portion 72 and the receiving portion 77. Moreover, by applying R-machining with an appropriate curvature to the base end portions (the corner portion of the connection portion with the disc portion 73) of the insertion portion 72 and the receiving portion 77, the stress can be further distributed, whereby occurrence of stress concentration can be prevented.

Moreover, since the shape of the disc portion 73 has a plurality of types of the thicknesses T1 to T3, the stress can be distributed even on the boundary portion (where the insertion portion 72 and the receiving portion 77 are located in this embodiment) between the portions with different thicknesses (where the insertion portion 72 and the receiving portion 77 are located in this embodiment).

Subsequently, in the turbo-molecular pump 10 in this embodiment, the insertion portion 72 of the cover portion 71 is inserted into the recess portion 41 of the rotor 28, and the distal end portion 74 of the insertion portion 72 is in contact with the washer 61 fixed in the recess portion 41. Thus, a space in the recess portion 41 can be reliably separated by the insertion portion 72 (particularly the portion where the distal end portion 74 and the washer 61 are in contact). And even if a particle (not shown) such as an Fe particle, for example, is generated in the recess portion 41, and this particle is to move to the side of the inlet portion 12 (FIG. 1) through the space between the insertion portion 72 and the washer 61, it can be blocked by the insertion portion 72.

The particle such as the Fe particle described above can be generated by various circumstances such as the materials (a type of stainless steel, a degree of magnetization and the like) of the components such as the rotor shaft 21 and the various bolts (the rotor fixing bolt 22, the cover-portion fixing bolt 86 and the like), a drying condition after washing, a type of a process gas to be used and the like. Moreover, the particle receives a force to move to the inlet side (the side of the inlet portion 12) by a pressure difference between the exhaust side (high-pressure side) and the inlet side (low-pressure side). Moreover, the particle receives a force to move to the side of the inlet portion 12 when a purge gas is made to flow into the main-body casing 14, too. Here, the purge gas is used for protecting a bearing portion, the rotor blade 20 and the like, preventing corrosion caused by the process gas, cooling the rotor blade 20 and the like.

However, by separating the inside and the outside of the insertion portion 72 while the insertion portion 72 is brought into surface contact with the washer 61 as in this embodiment, leakage of a particle emerging in the recess portion 41 to a space between the outer peripheral surface 75 of the insertion portion 72 and the inner peripheral surface of the recess portion 41 can be prevented. As a result, accumulation of the particle on the outer side surface 76 of the disc portion 73 in the cover portion 71 and leakage to the outside of the main-body casing 14 (side of a device to be exhausted) through the inlet portion 12 can be prevented.

Moreover, as described above, in the cover portion 71, deflection hardly occurs in the disc portion 73, the insertion portion 72 and the like regarding both the force generated in assembling related to the cover portion 71 and the force generated during the operation related to the turbo-molecular pump 10. Thus, a recess hardly occurs in the outer side surface 76 of the disc portion 73 so that accumulation of a particle in the recess can be prevented.

Moreover, since the distal end portion 74 of the insertion portion 72 is in contact with the washer 61 with a force which would generate a predetermined pressure (contact pressure) over the entire circumference (360°), high air-tightness (sealing performance) can be easily ensured inside and outside the insertion portion 72, and sealing of a particle into the insertion portion 72 can be enabled.

Furthermore, in this embodiment, the gap portion 64 is interposed between the outer peripheral surface 61*b* of the washer 61 and the inner peripheral surface of the recess portion 41. Thus, the contact length (length of the seal surface in the radial direction) L between the distal end portion 74 of the insertion portion 72 and the washer 61 as illustrated in FIG. 3 can be shortened, and a contact area can be made smaller. As a result, the contact pressure between the distal end portion 74 of the insertion portion 72 and the washer 61 can be further increased, and the sealing performance can be improved.

Here, supposing that a force for pressing the cover portion 71 to the washer 61 is constant, the smaller the above-described contact length L is, the more the contact pressure between the distal end portion 74 of the insertion portion 72 and the washer 61 is increased. Moreover, since a moment acts during rotation of the rotor 28 and the like, it is desirable that a thickness of the insertion portion 72 is made smaller (by thinning the insertion portion 72) so as to reduce an influence of the moment. Furthermore, since the insertion portion 72 is located closer to the outer side in the radial direction of the receiving portion 77, a relationship between rigidity and the moment can be optimized by thinning the insertion portion 72 and by increasing the thickness of the receiving portion 77.

Moreover, in this embodiment, the washer 61, which is a component separate from the rotor 28 is provided, and the distal end portion 74 of the insertion portion 72 in the cover portion 71 is in contact with this washer 61. Thus, the contact surface (seating surface) with the distal end portion 74 of the cover portion 71 only needs to be worked for the washer 61, and direct working on the contact surface (seat surface) is not required for the rotor 28, which is a relatively large-sized component. Therefore, there is no need to prepare a large-sized component or to mount it on a working machine in working on the seating surface, and the seating surface can be worked easily. And the space between the cover portion 71 and the washer 61 can be easily sealed with a desired contact pressure.

Moreover, since the relief portion 62 is formed on the washer 61, a burden of lapping between a corner part on a lower surface side of the washer 61 and a corner part on the bottom portion of the recess portion 41 of the rotor 28 is small. That is, if the relief portion 62 is not provided, the corner part on the lower surface side of the washer 61 interferes with the corner part on the bottom portion of the recess portion 41, and close contact of the washer 61 with a bottom surface of the recess portion 41 is expected to be difficult. However, by providing the relief portion 62 in the washer 61, such interference can be prevented, and the washer 61 can be easily brought into close contact with the bottom surface of the recess portion 41.

Subsequently, in the turbo-molecular pump 10 in this embodiment, the nozzle forming portion 78 is provided on the outer peripheral portion of the disc portion 73, and the nozzle portion 81 is formed over the entire periphery between the nozzle forming portion 78 and the opposing portion 27 of the rotor 28 (FIG. 2A). Moreover, the surface 78*a* on the inner side of the nozzle forming portion 78 is inclined so as to get closer to the side of the rotor 28, and the nozzle portion 81 is formed so that the spatial sectional area is narrowed as it goes from the center side toward the outer side in the radial direction of the disc portion 73.

Thus, in the nozzle portion 81, a flow of the gas by a nozzle effect can be generated, and a direction in which this gas flows is a direction on an outer peripheral side and toward the side of the rotor 28 (lower sides in each of FIG. 1, FIG. 2A), and FIG. 3). As a result, even if a particle flows out of the inner side of the insertion portion 72 to the outer side and reaches the inside of the nozzle portion 81 through the space between the outer peripheral surface of the insertion portion 72 and the inner peripheral surface of the recess portion 41, the gas containing this particle is ejected in a centrifugal direction from the nozzle portion 81 and a direction toward the side of the rotor 28 (lower side in each figure). Therefore, the direction in which the particle moves can be set to a side opposite to the inlet portion 12, and ejection of the particle directly toward the side of the inlet portion 12 can be prevented.

Moreover, in the turbo-molecular pump 10 in this embodiment, the O-ring 55 is provided between the rotor shaft 21 and the rotor 28. Thus, the air-tightness between the rotor shaft 21 and the rotor 28 can be improved by this O-ring 55, and entry of the gas to a side opposite to the flange portion 53 (side of the second shaft portion 52) by a pressure difference from a space 45 between the rotor 28 and the stator column 26 can be prevented.

Subsequently, in the turbo-molecular pump 10 in this embodiment, the gap portion 80 is formed in the receiving portion 77 of the cover portion 71. Thus, regarding the axial direction (vertical direction in each figure), a contact spot between the cover portion 71 and another component can be limited to one spot. As a result, tolerance between the cover portion 71 and peripheral components can be controlled easily, and assembling of the turbo-molecular pump 10 is easy.

That is, rotation of the rotor shaft 21 or the rotor 28 is performed under an environment of a normal temperature (under a normal-temperature environment) and under an environment heated to a predetermined temperature (approximately 100° C., for example) (under a high-temperature environment). And in these operation environments, when the rotor shaft 21 and the rotor 28 are rotated in the heated environment, a relative positional relationship between the end surface 51*a* of the first shaft portion 51 in the rotor shaft 21 and the surface (ceiling surface) 77*a* of the depth portion of the receiving portion 77 in the cover portion 71 is changed. Such a change in the positional relationship is generated by a factor such as thermal expansion in the axial direction (vertical direction in each figure), a difference in the material or the shape between the rotor shaft 21 and the cover portion 71 and the like.

However, by forming the gap portion 80 in advance, the change in the positional relationship between the rotor shaft 21 and the cover portion 71 can be absorbed. Thus, when the turbo-molecular pump 10 is assembled, there is no need to strictly control the tolerance of the end surface 51*a* of the first shaft portion 51, and the surface (ceiling surface) 77*a* of the depth portion of the receiving portion 77, and the assembling of the rotor shaft 21 and the cover portion 71 is easy.

Here, though not shown, the above-described high-temperature environment is formed by a heater (not shown) built in the exhaust-side casing 14*b* or a heater attached to the outer side of the main-body casing 14, or by exhausting of a high-temperature gas or the like, for example.

Moreover, if the end surface 51*a* of the first shaft portion 51 and the surface (ceiling surface) 77*a* of the depth portion of the receiving portion 77 are brought into contact without ensuring the gap portion 80, tolerance control for keeping a degree of contact proper is needed at two spots, that is, the above-described contact portion and a contact portion between the insertion portion 72 and the washer 61. However, by having one contact spot by providing the gap portion 80 as in this embodiment, a burden of the tolerance control can be reduced, and the assembling can be made easy.

Here, the assembling of the cover portion 71 in this embodiment is performed after the rotor 28 is coupled to the rotor shaft 21, and adjustment on rotation balance of the rotor 28 is performed. At this time, the insertion portion 72 of the cover portion 71 is inserted into the recess portion 41 of the rotor 28, the receiving portion 77 is made to cover the first shaft portion 51 of the rotor shaft 21, and moreover, the cover portion 71 is made to enter the recess portion 41 until the distal end portion 74 of the insertion portion 72 hits the washer 61. After that, the cover-portion fixing bolt 86 is inserted into the disc portion 73 and screwed into the first shaft portion 51 of the rotor shaft 21. And by tightening the cover-portion fixing bolt 86, the cover portion 71 is fixed to the rotor 28.

However, since the insertion portion 72 is fitted in the recess portion 41, positioning of the cover portion 71 can be performed to some degree by the positional relationship between the outer peripheral surface 75 of the insertion portion 72 and the inner peripheral surface of the recess portion 41. Thus, such a work is not needed that the cover-portion fixing bolt 86 is tightened while checking the rotation balance of the cover portion 71. Therefore, by means of this, too, the assembling of the cover portion 71 can be performed easily.

It is to be noted that, under the high-temperature environment as described above, the thermal expansion of the rotor shaft 21, the rotor 28, and the cover-portion fixing bolt 86 and the like acts in a complex manner And in a circumstance in which the rotor shaft 21 extends in the axial direction (particularly in a circumstance of extension in an upper direction in each figure), an axial force of the cover-portion fixing bolt 86 is changed as compared with a circumstance before the extension. However, by setting a torque at fastening of the cover-portion fixing bolt 86 properly, contact between the cover portion 71 and the washer 61 can be maintained even if the axial force is changed.

That is, since the gap portion 80 is formed in the receiving portion 77, loosening of the cover-portion fixing bolt 86 can be generated easily by the change in the axial force of the cover-portion fixing bolt 86. However, by tightening the cover-portion fixing bolt 86 by proper torque determined in advance as described above, the cover-portion fixing bolt 86 and the cover portion 71 can be assembled without loosening due to the change in the environment.

Subsequently, in the turbo-molecular pump 10 in this embodiment, since the cover portion 71 is formed of an aluminum alloy, the cover portion 71 becomes light-weighted as compared with a case using stainless steel and the like. And by reducing a weight of the cover portion 71, a moment during rotation is reduced, and the rotation balance can be kept more easily.

Moreover, in the turbo-molecular pump 10 in this embodiment, since electroless nickel plating is applied also to components made of stainless such as the rotor shaft 21, the cover-portion fixing bolt 86 and the like, generation of a particle can be prevented.

It is to be noted that the present invention is not limited to this embodiment but is capable of deformation in various ways within a range not departing from a gist. For example, the gap portion 80 is formed in the receiving portion 77 of the cover portion 71 in the above-described embodiment, but the end surface 51*a* of the first shaft portion 51 and the surface (ceiling surface) 77*a* of the depth portion of the receiving portion 77 may be brought into contact with each other without ensuring the gap portion 80 as long as the tolerance between the cover portion 71 and the peripheral components (the rotor shaft 21, the rotor 28, the washer 61, the cover-portion fixing bolt 86 and the like) can be controlled sufficiently.

Figure 2B:
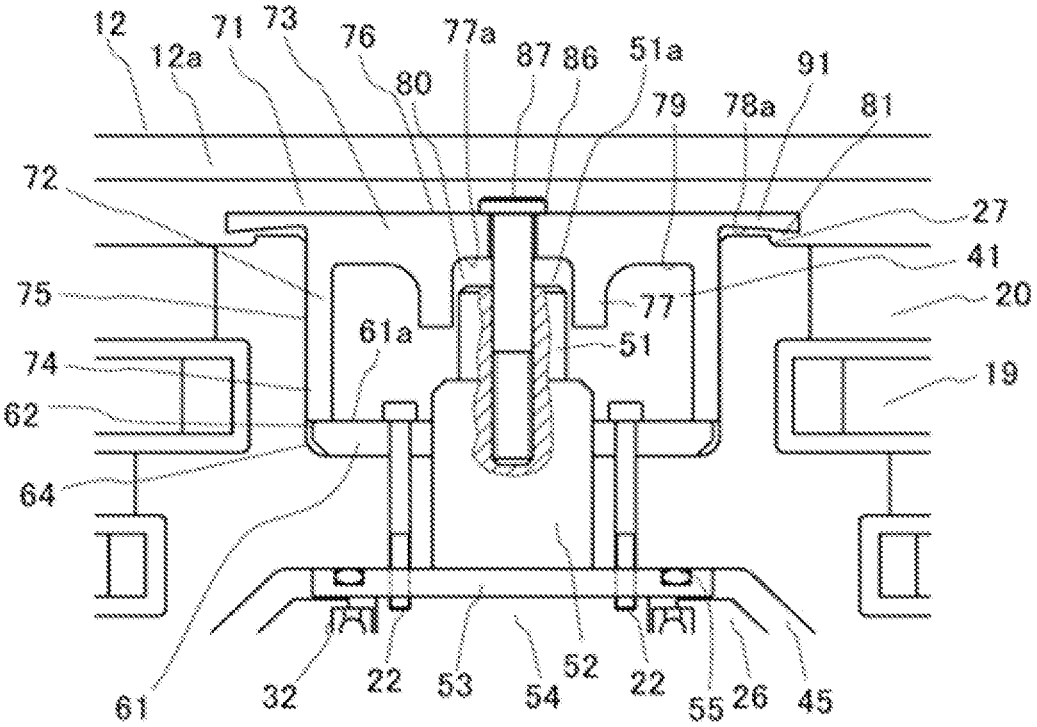
FIG. 2B is an enlarged view illustrating a cover member according to a variation and a peripheral portion thereof.

Moreover, in the above-described embodiment, as illustrated in FIG. 2A, the nozzle forming portion 78 substantially remains in a range opposed to the opposing portion 27, but the present invention is not limited thereto, but as illustrated in FIG. 2B as a variation, a nozzle forming portion 91 may be extended further to the outer peripheral side and formed so as to extend larger to an outer side from the opposing portion 27, for example. And the nozzle forming portion 91 may be extended to such a position that is opposed to a portion on a base end side of the rotor blade 20 over the entire circumference (360°).

By extending the nozzle forming portion 91 to the outer peripheral side as above, a range in which the nozzle effect is exerted can be extended. And in a case where an ejection force of a gas is not sufficient with the nozzle portion 81 in the embodiment illustrated in FIG. 2A, the ejection force can be increased by extending the nozzle forming portion 91 as in the variation illustrated in FIG. 2B.

Moreover, the material of the cover portion 71 is not limited to the aluminum alloy, but a stainless alloy can be also employed as the material for the cover portion 71 if the rotation balance can be sufficiently kept.

Furthermore, the present invention is not limited to the turbo-molecular pump but can be applied also to other types of vacuum pumps.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a casing having an inlet port or an outlet port;

a rotatable rotor shaft; and a rotor coupled to the rotor shaft, wherein a recess portion opened toward the inlet port is formed in the rotor;

a fastening portion of the rotor shaft is exposed to the recess portion; and a cover portion which is fastened to the fastening portion by a fastening means and covers at least a part of the recess portion, the cover portion being formed having a container shape and having:

a receiving portion comprising:

a ceiling surface opposed to and separated from an end surface of the fastening portion by a gap; and a reinforcing portion protruding from the ceiling surface of the receiving portion such that the reinforcing portion is separate from a periphery of the fastening portion and the reinforcing portion decreasing deflection of the cover portion by increasing rigidity; and a contact-pressure generating portion which is pressed by fastening to the fastening portion in a fastening direction and can cause a contact pressure to be generated in the fastening direction.

2. The vacuum pump according to claim 1, wherein the gap allows deflection of the cover portion.

3. The vacuum pump according to claim 1, wherein a contacted component with which the contact-pressure generating portion is in contact is provided in the recess portion; and the cover portion causes the contact pressure to be generated on a contact surface with the contacted component.

4. A vacuum pump component which can be fastened to a fastening portion of a rotor shaft provided in a vacuum pump and can cover at least a part of a recess portion of a rotor coupled to the rotor shaft, wherein the vacuum pump component is formed having a container shape and comprises:

a receiving portion comprising:

a ceiling surface configured to be opposed to and separated from an end surface of the fastening portion by a gap; and a reinforcing portion protruding from the ceiling surface of the receiving portion such that the reinforcing portion is configured to be separate from a periphery of the fastening portion and the reinforcing portion decreasing deflection by increasing rigidity of the vacuum pump component; and a contact-pressure generating portion which is pressed by fastening to the fastening portion in a fastening direction and can cause a contact pressure to be generated in the fastening direction.

* * * * *